US010294076B2

(12) United States Patent
Wurth et al.

(10) Patent No.: US 10,294,076 B2
(45) Date of Patent: May 21, 2019

(54) FALSE CAR DEVICE

(71) Applicant: Wurtec, Incorporated, Toledo, OH (US)

(72) Inventors: Steven P. Wurth, Sylvania, OH (US); Terry Rodebaugh, Whitehouse, OH (US); Andy Gries, Perrysburg, OH (US); Jeff Wagenhauser, Lambertville, MI (US); Doug Scott, Grosse Ile, MI (US)

(73) Assignee: Wurtec, Incorporated, Toledo, OH (US)

( * ) Notice: Subject to any disclaimer, the term of this patent is extended or adjusted under 35 U.S.C. 154(b) by 25 days.

(21) Appl. No.: 15/119,733

(22) PCT Filed: Feb. 18, 2015

(86) PCT No.: PCT/US2015/016247
§ 371 (c)(1),
(2) Date: Aug. 18, 2016

(87) PCT Pub. No.: WO2015/126863
PCT Pub. Date: Aug. 27, 2015

(65) Prior Publication Data

US 2017/0050822 A1 Feb. 23, 2017

Related U.S. Application Data

(60) Provisional application No. 61/942,661, filed on Feb. 21, 2014.

(51) Int. Cl.
*B66B 5/18* (2006.01)
*B66B 5/12* (2006.01)
(Continued)

(52) U.S. Cl.
CPC ..... *B66B 5/18* (2013.01); *B66B 5/04* (2013.01); *B66B 5/12* (2013.01); *B66B 5/22* (2013.01); *B66B 19/00* (2013.01)

(58) Field of Classification Search
CPC .... B66B 5/18; B66B 5/04; B66B 5/12; B66B 5/22; B66B 19/00
See application file for complete search history.

(56) References Cited

U.S. PATENT DOCUMENTS

D119,800 S 10/1871 Thorn
D162,252 S 4/1875 Perkins
(Continued)

FOREIGN PATENT DOCUMENTS

DE 3817339 A1 12/1988
EP 0464312 A1 1/1992
(Continued)

OTHER PUBLICATIONS

European Partial Supplementary Search Report, Application No. 15752631.0, dated Sep. 11, 2017.
(Continued)

*Primary Examiner* — Michael A Riegelman
(74) *Attorney, Agent, or Firm* — MacMillan, Sobanski & Todd, LLC

(57) ABSTRACT

A false car device configured for use in an elevator hoistway is provided. The false car device includes a platform assembly and a frame assembly configured to support the platform assembly. The frame assembly includes one or more safety assemblies. A lift assembly is configured to facilitate hoisting of the platform and the frame assembly within the elevator hoistway. A climbing rope is attached to the lift assembly and has a tension. The safety assembly is configured to engage an elevator guide rail in the event the tension in the climbing rope is lost.

16 Claims, 8 Drawing Sheets

(51) Int. Cl.

| | |
|---|---|
| ***B66B 19/00*** | (2006.01) |
| ***B66B 5/04*** | (2006.01) |
| ***B66B 5/22*** | (2006.01) |

(56) References Cited

U.S. PATENT DOCUMENTS

| | | | | | |
|---|---|---|---|---|---|
| 467,985 | A * | 2/1892 | Bacorn | B66B 19/06 | 187/391 |
| 1,819,502 | A * | 8/1931 | Dunlop | B66B 5/18 | 187/375 |
| 1,864,588 | A * | 6/1932 | Dunlop | B66B 5/044 | 187/350 |
| 1,886,213 | A * | 11/1932 | Murphy | B66B 5/20 | 187/370 |
| 1,918,427 | A | 7/1933 | Rice | | |
| 1,931,217 | A | 10/1933 | Zouck | | |
| 1,931,237 | A * | 10/1933 | O'Connell | B66B 5/18 | 187/359 |
| 2,719,608 | A * | 10/1955 | Callaway | B66B 5/22 | 187/373 |
| 3,441,107 | A * | 4/1969 | Dingfeld | B66B 5/04 | 187/350 |
| 3,851,736 | A | 12/1974 | Westlake et al. | | |
| 4,974,700 | A | 12/1990 | Gates | | |
| 5,020,641 | A | 6/1991 | Olsen et al. | | |
| 5,065,843 | A | 11/1991 | Richards | | |
| 5,230,404 | A | 7/1993 | Klein | | |
| 5,299,661 | A * | 4/1994 | Pramanik | B66B 5/044 | 187/373 |
| 5,301,773 | A * | 4/1994 | Jamieson | B66B 5/22 | 187/376 |
| 5,353,895 | A * | 10/1994 | Camack | B66B 5/18 | 187/369 |
| 5,553,686 | A | 9/1996 | Jensen | | |
| D416,000 | S | 11/1999 | Morooka | | |
| 6,164,418 | A | 12/2000 | Chen et al. | | |
| 6,318,507 | B1 * | 11/2001 | Jin | B66B 5/04 | 187/351 |
| D467,985 | S | 12/2002 | Tang et al. | | |
| 8,141,683 | B1 | 3/2012 | Wurth et al. | | |
| 8,485,319 | B2 | 7/2013 | Peacock et al. | | |
| 9,816,796 | B2 * | 11/2017 | Wurth | G01B 5/20 | |
| 2003/0136611 | A1 | 7/2003 | Emy et al. | | |
| 2004/0112683 | A1 * | 6/2004 | Liebetrau | B66B 5/18 | 187/372 |
| 2007/0170010 | A1 * | 7/2007 | Higashinaka | B66B 5/18 | 187/374 |
| 2010/0018809 | A1 * | 1/2010 | Peacock | B66B 5/005 | 187/251 |
| 2010/0309452 | A1 * | 12/2010 | Qiu | B66B 19/00 | 356/3 |
| 2011/0024231 | A1 | 2/2011 | Wurth et al. | | |
| 2011/0088972 | A1 | 4/2011 | Gregus et al. | | |
| 2013/0248299 | A1 * | 9/2013 | Perala | B66B 19/00 | 187/359 |
| 2015/0041256 | A1 * | 2/2015 | Okada | B66B 5/0031 | 187/254 |
| 2016/0102962 | A1 * | 4/2016 | Wurth | G01B 5/20 | 33/533 |

FOREIGN PATENT DOCUMENTS

| | | | |
|---|---|---|---|
| JP | 52137463 | U | 10/1977 |
| JP | 05278968 | A | 10/1993 |
| JP | 11278769 | A | 10/1999 |
| JP | 2999706 | B2 | 1/2000 |
| JP | 2005239378 | A | 9/2005 |

OTHER PUBLICATIONS

European Supplementary Search Report, Application No. 15752631.0, dated Dec. 12, 2017.

CN First Office Action, Application No. 201580013581.5, dated Mar. 13, 2018.

* cited by examiner

FALSE CAR DEVICE

RELATED APPLICATIONS

This application claims the benefit of U.S. Provisional Application No. 61/942,661, filed Feb. 21, 2014, the disclosure of which is incorporated herein by reference in its entirety.

BACKGROUND

Elevators are typically constructed within a building structure commonly referred to as an elevator hoistway. In some instances, elevator hoistways can be defined by four walls that extend from a lower level of the building (referred to as a pit) to an upper level of the building. The hoistway walls can be formed from a variety of materials including cement, concrete block, drywall and glass block. In other instances, the hoistway can be formed by metal structures, such as for example, beams configured to surround the space forming the hoistway.

Various components forming the elevator, such as for example, guide rails, electrical switches, hoistway doors and electrical conduit can be attached to the hoistway walls and/or the beams at various vertical levels of the hoistway.

During construction or subsequent maintenance of the elevator, it can be desirable to have a temporary work platform and/or work surface within the hoistway. The temporary work platform can be used by construction or maintenance personnel as a support platform from which various elevator components forming the elevator can be attached to the hoistway walls or beams. The temporary work platform can also be used as a temporary storage area for components to be attached to the hoistway walls or beams. In certain instances, the temporary work platform can be moved from one level of the hoistway to another level of the hoistway as the construction or maintenance of the elevator proceeds.

In certain instances, the temporary work platform is formed from scaffolding consisting of a modular system of metal pipes or tubes, couplers and boards. In this system, the metal pipes and couplers are used to form a structure upon which the boards are installed to form a working platform. As the work progresses within the elevator hoistway, additional scaffolding is added to the existing scaffolding in order to move the working platform to higher levels.

In other instances, a device called a false car can be used as a temporary work platform. The false car can be suspended from an upper hoistway location and can travel vertically within the hoistway on a separate climbing rope by means of a winch mounted on the false car or within the hoistway.

It would be advantageous if false cars could be improved.

SUMMARY

The above objects as well as other objects not specifically enumerated are achieved by a false car device configured for use in an elevator hoistway. The false car device includes a platform assembly and a frame assembly configured to support the platform assembly. The frame assembly includes one or more safety assemblies. A lift assembly is configured to facilitate hoisting of the platform and the frame assembly within the elevator hoistway. A climbing rope is attached to the lift assembly and has a tension. The safety assembly is configured to engage an elevator guide rail in the event the tension in the climbing rope is lost.

The above objects as well as other objects not specifically enumerated are also achieved by a false car device for use in an elevator hoistway. The false car device includes a frame assembly configured to support a platform. The frame assembly includes one or more safety assemblies. One or more guide shoes is connected to the frame. Each of the guide shoes has a face configured to contact a surface of a guide rail. A rail adjustment member is coupled to the one or more guide shoes. The rail adjustment member is configured to adjust a distance between the opposing faces of the guide shoes to ensure contact of the opposing faces of the guide shoes with surfaces of the guide rail as the false car device moves within the hoistway.

The above objects as well as other objects not specifically enumerated are also achieved by a false car device for use in an elevator hoistway. The false car device includes a frame assembly configured to support a platform. The frame assembly includes one or more safety assemblies. Opposing guide shoes are connected to the frame. The guide shoes are centered about and in contact with a surface of a guide rail such as to determine a centerline of the guide rail. The determination of the centerline of the guide rail by the false car allows the false car to be used as a gauge in installing other hoistway equipment.

Various objects and advantages of the false car device will become apparent to those skilled in the art from the following detailed description of the preferred embodiment, when read in light of the accompanying drawings.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

The description and figures disclose a false car device configured for use as a temporary work platform within an elevator hoistway. Generally, the false car device is suspended from one or more climbing ropes and is configured for vertical movement from one level of the elevator hoistway to another level. The false car device includes a safety assembly configured to engage an elevator guide rail in the event of a loss of tension in the one or more climbing ropes.

The term "elevator hoistway," as used herein, is defined to mean a vertically-oriented space within a building within which one or more elevators, dumbwaiters, or material lifts travel. The term "false car device" as used herein, is defined to mean a vertically movable platform configured for use by elevator personnel within an elevator hoistway.

Figure 1:
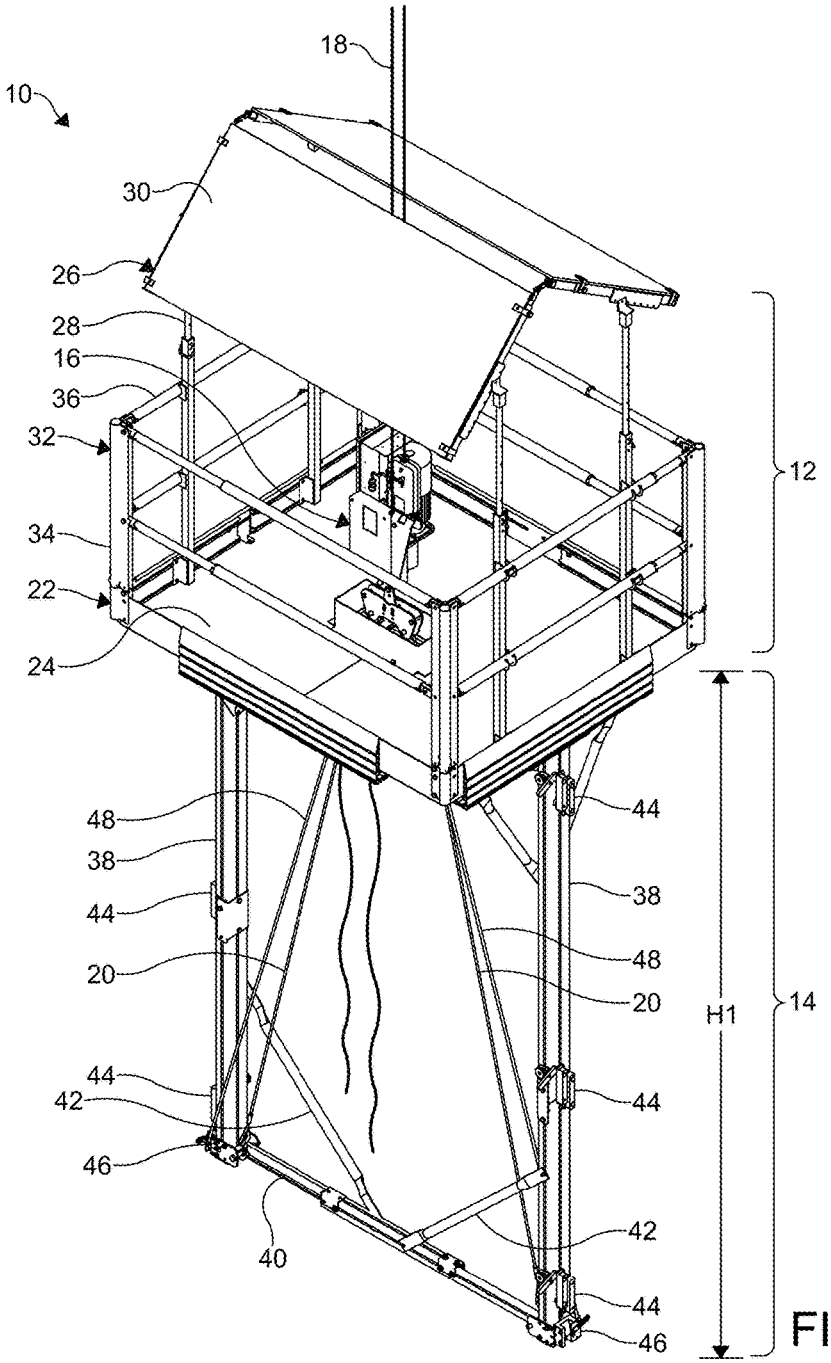
FIG. 1 is a schematic perspective view of a false car device.

Referring now to FIG. 1, one embodiment of a false car device is shown generally at 10. The false car device 10 includes a platform assembly 12, a frame assembly 14 and a lift assembly 16. The false car device 10 is suspended within an elevator hoistway by a climbing rope 18. The lift assembly 16 is configured to facilitate hoisting of the platform assembly 12 and the frame assembly 14 within the elevator hoistway. In the illustrated embodiment, the frame assembly 14 is suspended from the lift assembly 16 by opposing suspension ropes 20, and the platform assembly 12 is attached to and supported by the frame assembly 14. In other embodiments, the platform assembly 12, frame assembly 14 and lift assembly 16 can be connected and supported in other arrangements.

Referring again to FIG. 1, the platform assembly 12 includes a deck 22 having one or more platform surfaces 24 disposed thereon. The platform surface 24 can be removable and is configured to provide a supporting surface for personnel positioned within the elevator hoistway. The platform surface 24 can be made of any desirable material, such as for example, plywood or aluminum. The platform surface 24 can have any desired thickness, such as for example, 0.75 inches or 1.0 inch. Optionally, the platform surface 24 can have any desired surface coating or finish, including the non-limiting example of a non-skid coating.

Referring again to FIG. 1, the platform assembly 12 may include an optional overhead canopy 26. The canopy 26 is supported by a plurality of telescoping uprights 28 that extend vertically from the deck 22. The distance of the canopy 26 from the deck 22 is adjustable via the telescoping uprights 28 and the canopy 26 can be removed from the platform assembly 12 if desired. The canopy 26 is configured to provide overhead protection to personnel positioned on the platform assembly 12. In certain embodiments, the canopy 26 may be formed from one or more rigid panels 30 disposed at an oblique angle to the platform surface 24. Alternatively, the panels 30 may be disposed in a parallel arrangement to the platform surfaces 24. The panels 30 can be made of any desirable material, such as for example, plywood or aluminum. The panels 30 can have any desired thickness, such as for example, 0.75 inches or 1.0 inch. In still other embodiments, the canopy 26 can be formed from other structures and can have other arrangements. As one non-limiting example, the canopy 26 can be formed as a lone flat panel formed with a lattice-type of material, such as for example mesh.

Referring again to FIG. 1, a rail structure 32 extends in an upward direction from a perimeter of the deck 22. The rail structure 32 is configured to protect personnel positioned on the platform assembly 12 from falling off of the deck 22. In the illustrated embodiment, the rail structure 32 includes a plurality of posts 34 connected by telescoping crossmembers 36. The length of the crossmembers 36 is adjustable to accommodate an adjustable width and depth of the deck 22, as described below.

Referring again to FIG. 1, the frame assembly 14 includes a pair of side stiles 38, each having a first end and a second end. The first ends of the side stiles 38 are connected to, and configured to support the deck 22 of the platform assembly 12. A cross channel 40 spans the distance between, and is connected to the second ends of the side stiles 38. The frame assembly 14 may further include a pair of cross channel supports 42 connecting intermediate portions of the side stiles 38 to the cross channel 40.

Referring again to FIG. 1, the frame assembly 14 has a height H1. Advantageously, the height H1 of the frame assembly 14 can be adjusted by adding or removing components, such as for example spacers (not shown), as may be necessary or desirable depending on hoistway conditions or characteristics of the equipment to be installed.

The frame assembly 14 is configured to support one or more guide assemblies 44 and one or more safety assemblies 46. In the illustrated embodiment, a quantity of three guide assemblies 44 are attached to each of the side stiles 38. However, in other embodiments, more or less than three guide assemblies 44 can be attached to each of the side stiles 38. Advantageously, a vertical position of the guide assemblies 44 may be adjusted by relocating the guide assemblies 44 along the side stiles 38. The safety assemblies 46 are disposed at each of the second ends of the side stiles 38. The structure and function of the guide assemblies 44 and the safety assemblies 46 will be further described below.

Referring again to FIG. 1, the suspension ropes 20 connect the frame assembly 14 to the lift assembly 16. A first end of each of the suspension ropes 20 attaches to the lift assembly 16, and a second end of each of the suspension ropes 20 attaches to the frame assembly 14 at a position adjacent to the second end of each of the side stiles 38.

The false car 10 further includes one or more safety ropes 48 coupling the lift assembly 16 to each of the safety assemblies 46. A first end of each of the safety ropes 48 attaches to the lift assembly 16 and a second end of each of the safety ropes 48 attaches to one of the safety assemblies 46.

Figure 2:
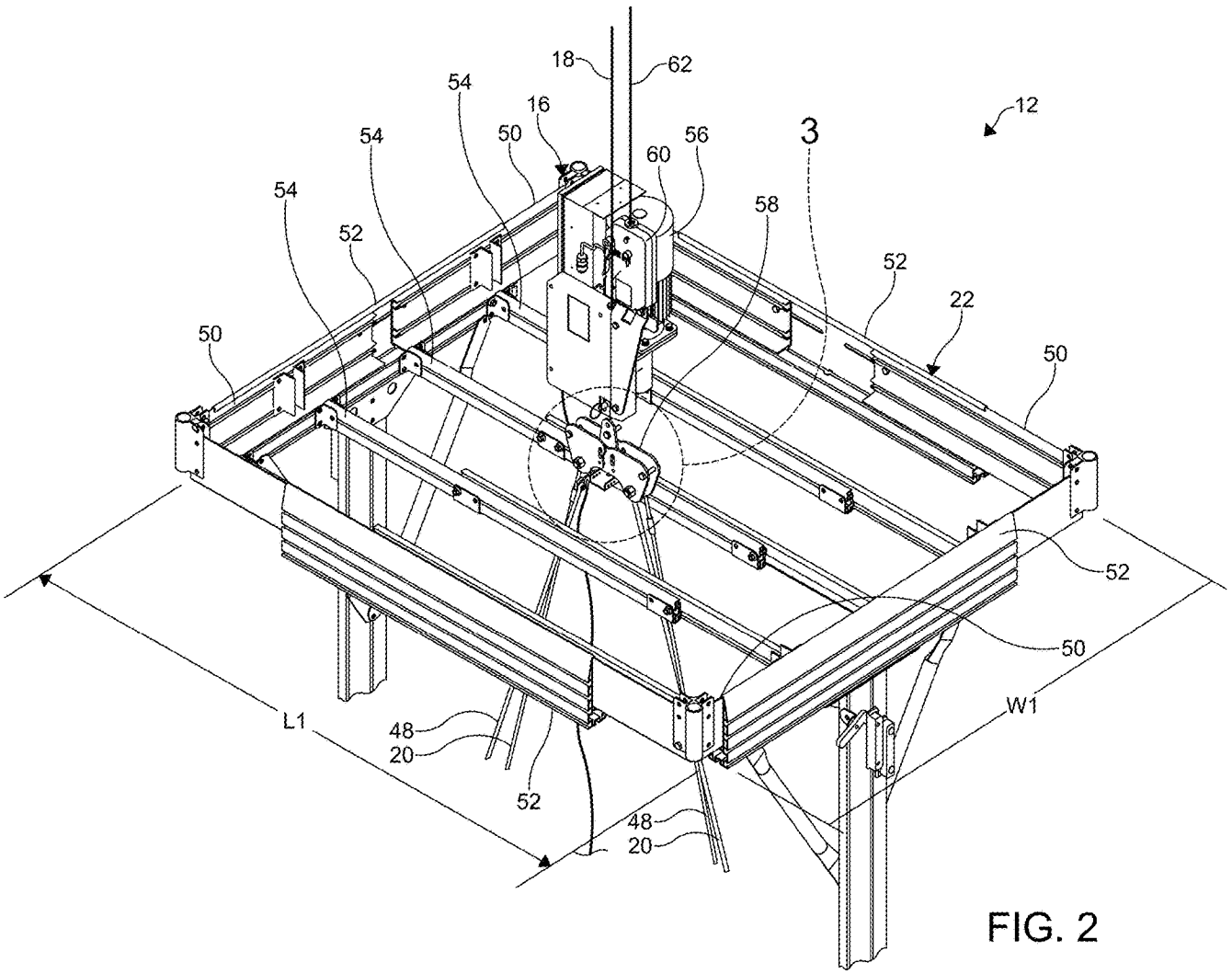
FIG. 2 is a schematic perspective view of a portion of the false car device of FIG. 1, illustrating a platform assembly and a lift assembly.

Referring now to FIG. 2, the deck 22 (illustrated without the platform surface 24) includes corner members 50, side members 52, and one or more pairs of mating extension members 54. Generally, the side members 52 are configured to slidably attach to the corner members 50. At the same time, the mating pairs of extension members 54 telescope, thereby allowing a width and a length of the platform assembly 12 to adjust to inner dimensions of the elevator hoistway. In the illustrated embodiment, the platform assembly 12 has an adjustable length L1 in a range of from about 72.0 inches to about 96.0 inches and an adjustable width W1 in a range of from about 61.0 inches to about 75.0 inches. However, in other embodiments, the length L1 can be less than about 72.0 inches or more than about 96.0 inches and the width W1 can be less than about 61.0 inches or more than about 75.0 inches.

Referring again to FIG. 2, the lift assembly 16 includes a hoist 56 and a hoist bracket assembly 58. In the illustrated embodiment, the climbing rope 18 is received by the hoist 56, and the hoist 56 moves vertically along the climbing rope 18 as the false car device 10 is raised and lowered in the elevator hoistway. In alternative embodiments, the hoist 56 may be attached to the elevator hoistway in a stationary configuration. In a stationary configuration, the first end of the climbing rope 18 is secured to the false car device 10, and the hoist 56 remains stationary as the false car device 10 is raised and lowered.

Optionally, the lift assembly 16 may include an overspeed device 60 configured to prevent overspeeding of the false car device 10. The term "overspeeding", as used herein, is defined to mean traveling at a speed in excess of a maximum desired speed. A secondary rope 62 is suspended from the elevator hoistway, and is received by the overspeed device 60. In the event the overspeed device 60 senses that the speed of the false car device 10 exceeds the maximum desired speed, the overspeed device 60 engages the secondary rope 62 to impede further movement of the false car device 10. The overspeed device 60 may sense the speed of the false car device 10 by measuring the speed that the secondary rope 62 passes through the overspeed device 60. Alternatively, a speed sensing device (not shown) may communicate the speed of the false car device 10 to the overspeed device 60. The overspeed device 60 can be any suitable structure, mechanism or device configured to prevent overspeeding of the false car device 10. One non-limiting example of a suitable overspeed device is the Blocstop™ Fall Arrest Device marketed by Tractel Corporation, headquartered in Norwood, Mass.

Referring again to FIG. 2, the hoist bracket assembly 58 is shown attached to the hoist 56 of the lift assembly 16. However, as described above, the hoist bracket assembly 58 may be attached to the first end of the climbing rope 18 when the hoist 56 is in the stationary configuration. The suspension ropes 20 and the safety ropes 48 are shown attached to the hoist bracket assembly 58, and are described in greater detail below.

Figure 3:
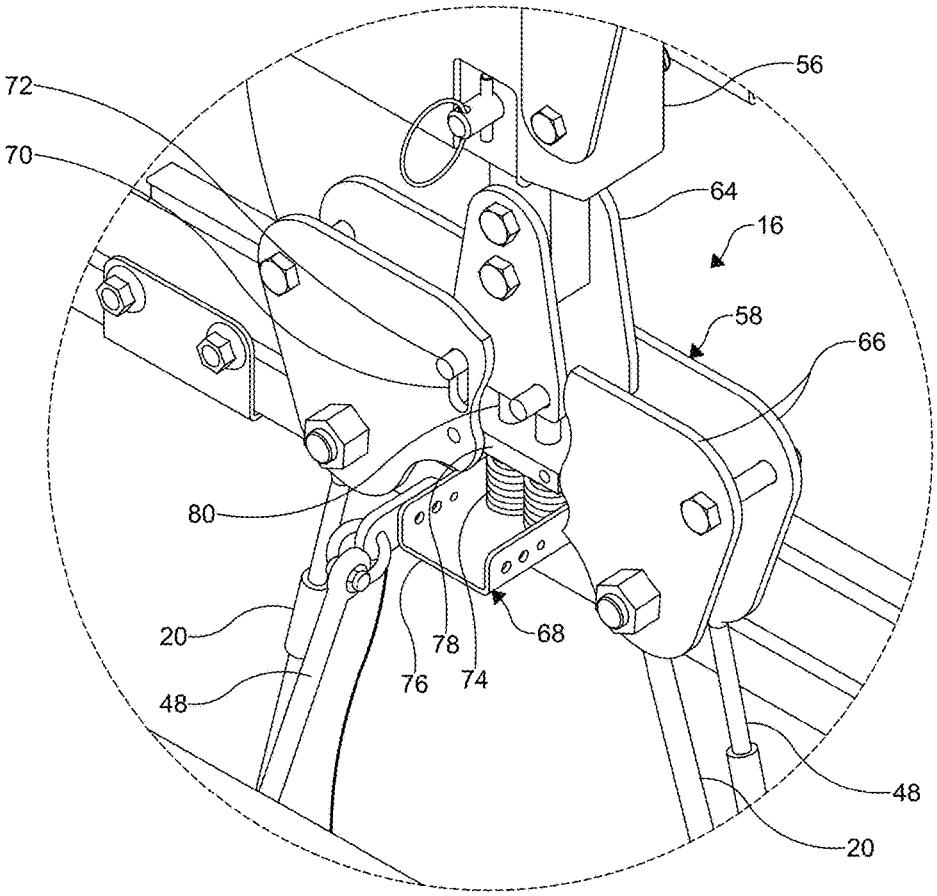
FIG. 3 is a perspective view of a portion of the lift assembly of FIG. 2, illustrating the lift assembly in a contracted arrangement.
Figure 4:
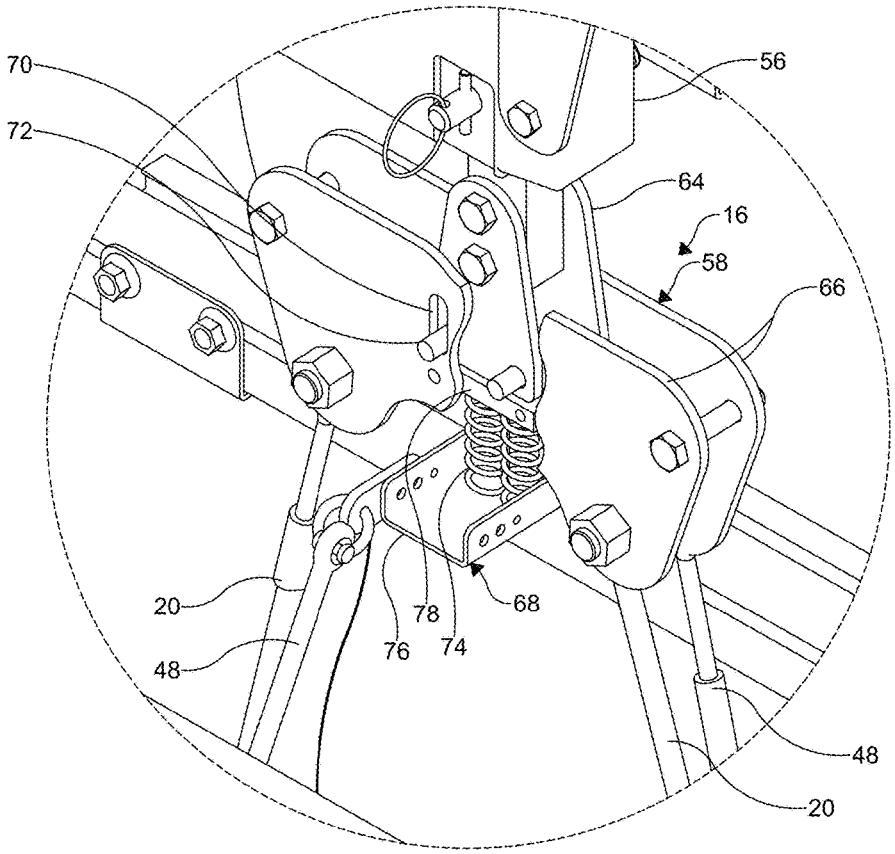
FIG. 4 is a perspective view of a portion of the lift assembly of FIG. 2, illustrating the lift assembly in an expanded arrangement.

Referring now to FIGS. 3 and 4, the lift assembly 16 is shown in detail. A portion of the hoist bracket assembly 58 has been cut away for purposes of clarity.

The hoist bracket assembly 58 includes a hoist clevis 64, a pair of opposing side plates 66 and a safety actuator 68. The hoist clevis 64 depends from the hoist 56 and the side plates 66 are slidably coupled to the hoist clevis 64. The side plates 66 include one or more slots 70 formed therein. One or more pins 72 extend from the hoist clevis 64 and are slidably received in the slots 70 of the side plates 66. It should be understood that the hoist bracket assembly 58 may include any number of side plates 66, and that the side plates 66 may be slidably coupled to the hoist clevis 64 by any quantity of slots 70 and pins 72. Further, in other embodiments, the side plates 66 may be slidably coupled to the hoist clevis 64 by other structures, mechanisms or devices.

Referring again to FIGS. 3 and 4, the safety actuator 68 includes a spring device 74, an actuator plate 76, a bias block 78, and one or more guide rods 80. The guide rods 80 depend from the hoist clevis 64. The actuator plate 76 is fixed to a distal end of the guide rods 80. The bias block 78 is slidably disposed on the guide rods 80 intermediate the actuator plate 76 and the hoist clevis 64, and is fixedly coupled to the side plates 66 of the hoist bracket assembly 58. Accordingly, the bias block 78 and the side plates 66 move in unison on the guide rods 80. The spring device 74 is configured to bias the bias block 78 apart from the actuator plate 76. In the illustrated embodiment, the spring device 74 includes one or more compression springs disposed about the guide rods 80 and intermediate the actuator plate 76 and the bias block 78. Alternatively, the spring device 74 can be formed from other mechanisms and devices.

As shown in FIGS. 3 and 4, the first ends of the safety ropes 48 are coupled to the actuator plate 76 of the hoist bracket assembly 58, and first ends of the suspension ropes 20 are coupled to the side plates 66 of the hoist bracket assembly 58.

The hoist bracket assembly 58 can be configurable in a contracted arrangement and in an expanded arrangement. The contracted arrangement is shown in FIG. 3 and occurs when there is tension in the climbing rope 18, as shown in FIG. 1. In the contracted arrangement, the side plates 66 are contracted with respect to the actuator plate 76, and the spring device 74 is compressed by the bias block 78. Referring now to FIG. 4, the hoist bracket assembly 58 is shown in an expanded arrangement. The expanded arrangement occurs when there is no tension in the climbing rope 18. In the expanded arrangement, the side plates 66 are extended with respect to the actuator plate 76, and the spring device 74 is expanded to bias the bias block 78 apart from the actuator plate 76.

Referring now to FIGS. 5-8, the safety assembly 46 is illustrated. The safety assembly 46 includes one or more mounting plates 82 and a brake block 84. The mounting plates 82 of the safety assembly 46 attach to front and back faces of the side stiles 38 of the frame assembly 14. In the illustrated embodiment, the safety assemblies 46 include a mounting pin 86 for coupling the second end of the suspension rope 20 to the safety assembly 46. However, in alternate embodiments, the mounting pin 86 and the suspension ropes 20 may be coupled to the side stiles 38 or the cross channel 40 of the frame assembly 14 with other structures, mechanisms or devices.

A safety lever 88 is rotatably attached to one of the mounting plates 82. The safety lever 88 includes a necked portion 90 extending therefrom. The second end of the safety rope 48 attaches to the necked portion 90 of the safety lever 88, and facilitates rotation of the safety lever 88 during operation of the safety assembly 46. As described in more detail below, tension in the safety rope 48 causes the safety lever 88 to bias the safety assembly 46 towards an unengaged arrangement.

Figure 8:
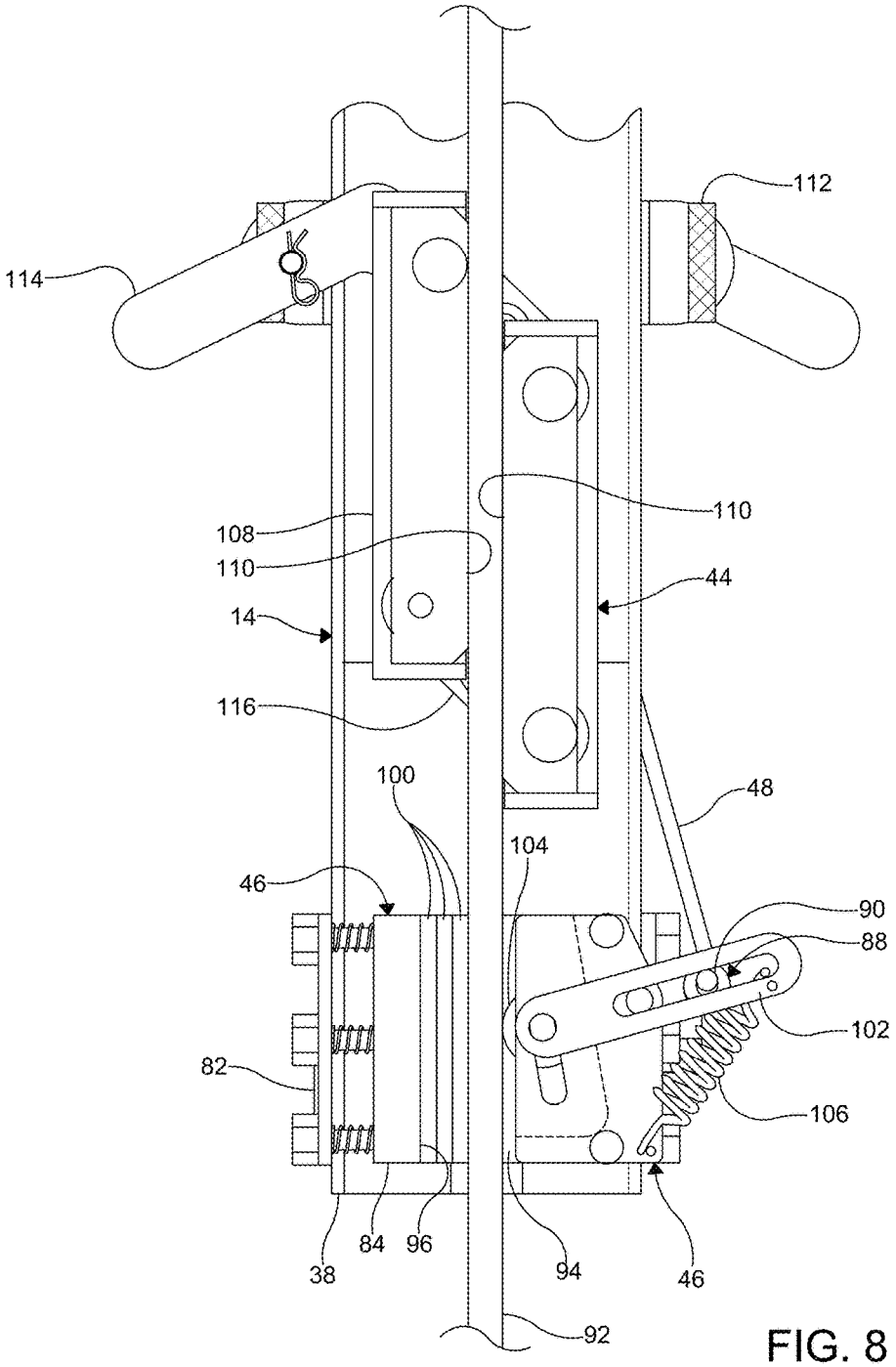
FIG. 8 is a detail view, in elevation, of the safety assembly of FIG. 5, illustrating engagement of the safety assembly with an elevator guide rail.

Referring now to FIG. 8, the brake block 84 is attached to an outside face of the side stile 38, and is configured to receive a portion of an elevator guide rail 92 therein.

Referring again to FIGS. 6 and 7, the brake block 84 includes a channel 94 formed between a friction member 96 and an inclined member 98. A width of the channel 94 may be adjusted by adding spacers 100 or removing spacers 100 from the friction member 96.

Referring again to FIGS. 5-8, a link arm 102 is attached to the brake block 84 and rotates about an axis transverse to an axis of the safety lever 88. The necked portion 90 of the safety lever 88 is received through a first end of the link arm 102. A roller 104 is coupled to a second end of the link arm 102, and is disposed within the channel 94 of the brake block 84, wherein the roller 104 contacts the inclined member 98 of the channel 94. The rotation axis of the link arm 102 is intermediate the roller 104 and the necked portion 90 of the safety lever 88, wherein a generally downward motion of the necked portion 90 results in a generally upward motion of the roller 104, and vice versa.

A lever spring 106 is configured to bias the safety assembly 46 towards an engaged arrangement, wherein the roller 104 engages a face of the guide rail 92. More specifically, the lever spring 106 is configured to bias the second end of the link arm 102 in a downward direction, causing the roller 104 to move in an upward direction. In the illustrated embodiment, the lever spring 106 is an extension spring, and connects the second end of the link arm 102 with the brake block 84. It will be appreciated that the lever spring 106 may be any type of elastic device suitable for biasing the safety assembly 46 towards the engaged arrangement, such as for example a compression spring or a torsion spring.

Figure 6:
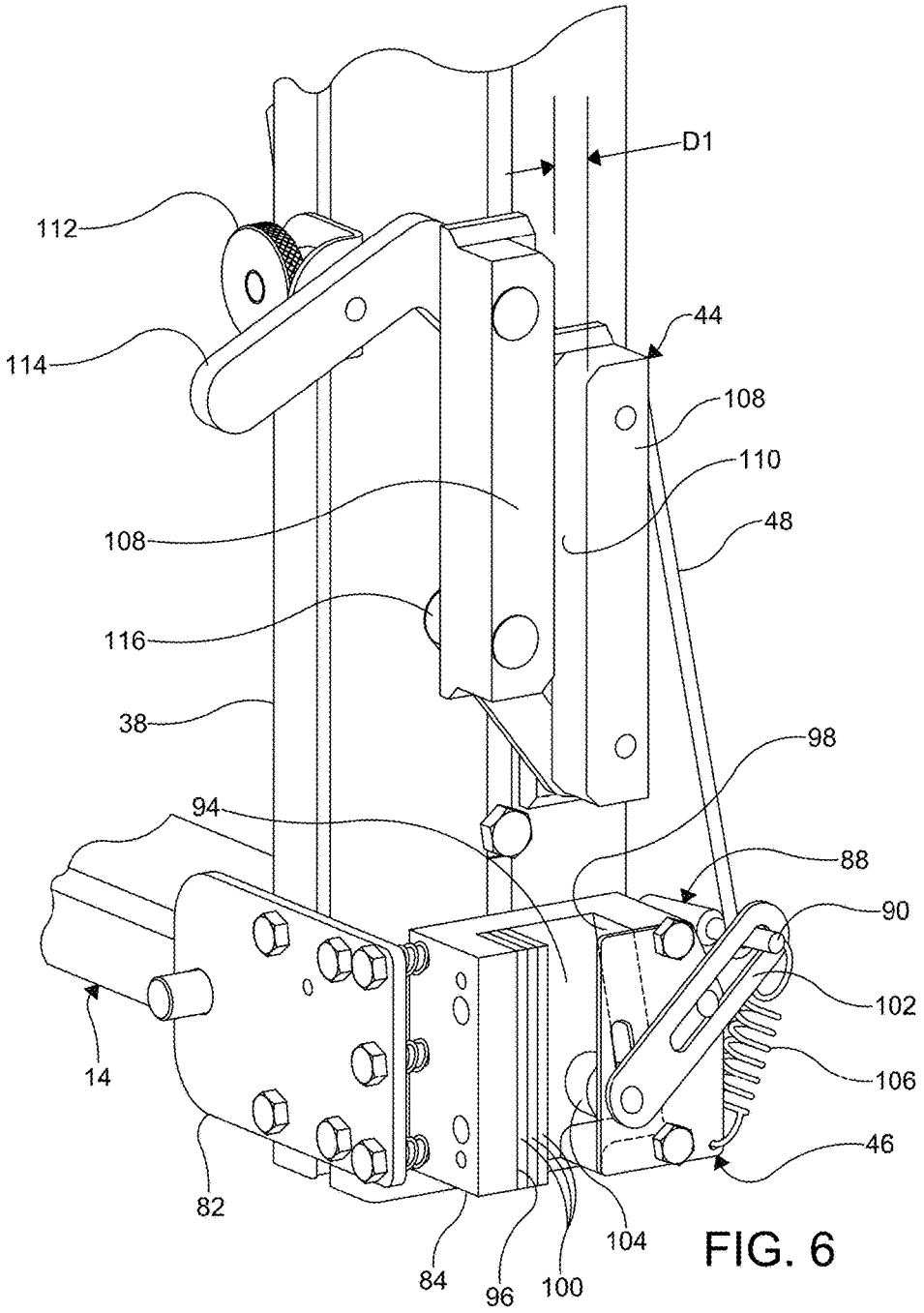
FIG. 6 is a schematic perspective view of the safety assembly FIG. 5, illustrating the safety assembly in an unengaged arrangement.
Figure 7:
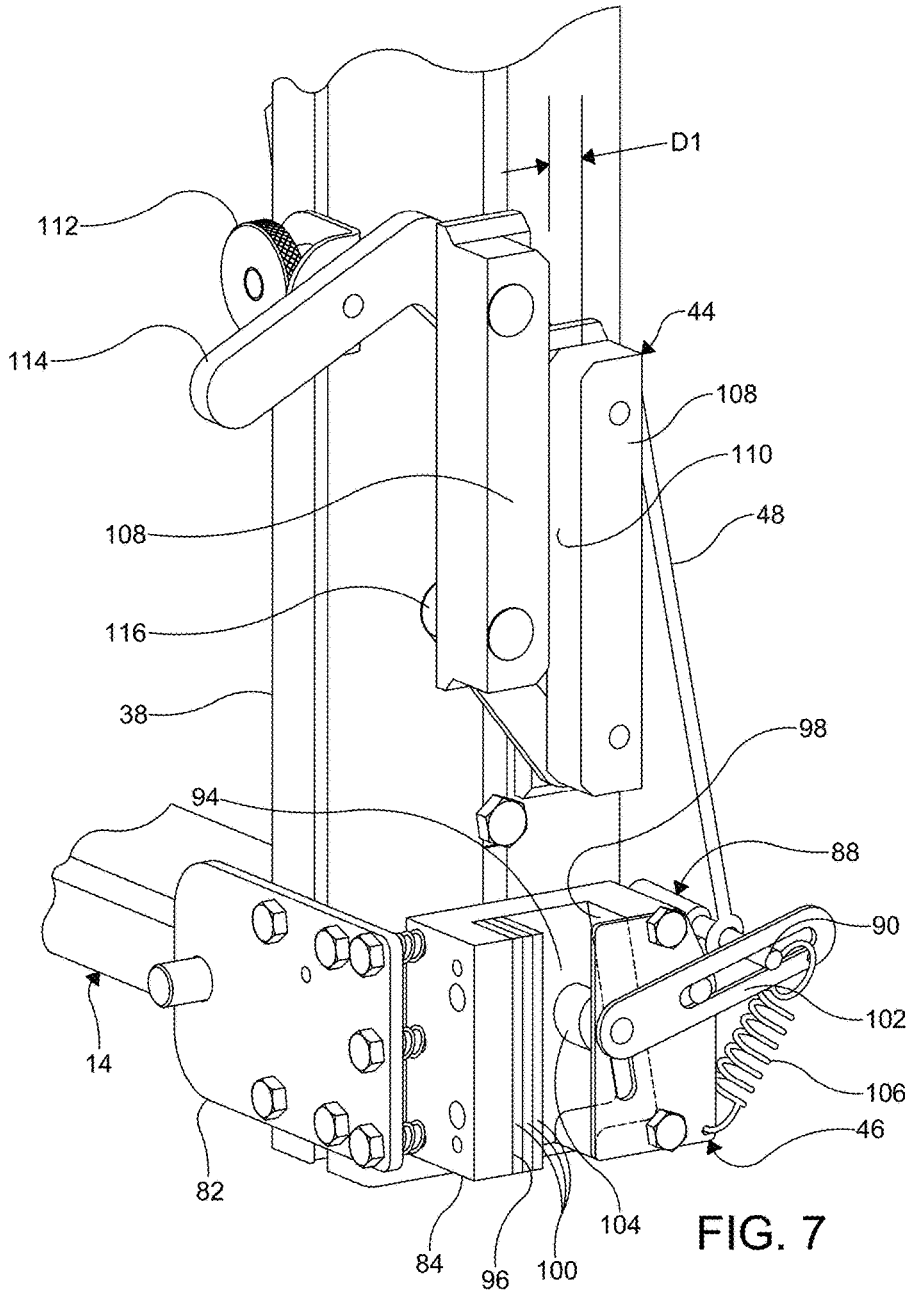
FIG. 7 is a schematic perspective view of the guide assembly and the safety assembly of FIG. 5, illustrating the safety assembly in an engaged arrangement.

Referring now to FIGS. 6-8, the roller 104 can be formed with textured surfaces, such as for example knurled surfaces, configured to engage the face of the guide rail without imparting damage to the guide rails 92. In still other embodiments, the roller 104 can be made of materials, such as for example, high strength polymeric materials, configured to engage a guide rail face without imparting damage to the guide rails 92. In still other embodiments, structures, mechanisms and devices other than a roller 104 can be used to engage a guide rail face without imparting damage to the guide rails 92. One non-limiting example of another structure is a wedge shaped block.

Referring again to FIGS. 6-8, the guide assembly 44 includes one or more guide shoes 108. The guide shoes 108 have opposing faces 110. The opposing faces 110 of the guide shoes 108 are formed of materials configured to slidably contact opposing faces of elevator guide rails 92, thereby allowing the false car device 10 to move vertically within the elevator hoistway with the faces 110 of the guide shoes in contact with the guide rails 92. The opposing faces 110 of the guide shoes 108 may be formed of a material having a low coefficient of friction, such as for example 0.35 or less. In the disclosed embodiment, the opposing faces 110 are formed of a polymeric material, such as for example nylon. However, it should be appreciated that the opposing faces 110 of the guide shoes 108 can be formed from other desired materials having other coefficients of friction sufficient to allow the false car device 10 to move vertically within the elevator hoistway with the faces 110 of the guide shoes in contact with the guide rails 92.

Referring again to FIGS. 6 and 7, a distance D1 is formed between the opposing faces 110. The distance D1 is configured to correspond with the width of the opposing faces of the guide rail 92. The distance D1 is adjustable to accommodate guide rails 92 having differing widths. Since the distance D1 is adjustable, advantageously, the guide assemblies 44 will work on guide rails 92 having different widths. In the illustrated embodiment, the guide assemblies 44 can accommodate guide rails 92 having widths in a range of from about 16 mm to about 32 mm. In other embodiments, the guide assemblies 44 can accommodate guide rails 92 having widths less than about 16 mm or more than about 32 mm.

Referring again to FIGS. 6 and 7, the guide assembly 44 includes an adjustment rotator 112, a rail adjustment member 114, and a rotator link 116. The adjustment rotator 112 is coupled to the side stile 38, and is configured to move vertically along the side stile 38. The rail adjustment member 114 is pivotally coupled to each of the adjustment rotator 112 and the one or more guide shoes 108. The rotator link 116 is pivotally coupled to the one or more guide shoes 108.

The adjustment rotator 112, the rail adjustment member 114, and the rotator link 116 cooperate to adjust the distance D1 to accommodate guide rails 92 having differing widths. While the illustrated embodiment incorporates the adjustment rotator 112, the rail adjustment member 114, and the rotator link 116, it should be appreciated that in other embodiments, the distance D1 between the opposing faces 110 can be adjusted by other mechanisms, devices and structures.

Generally, the safety assembly 46 is configured in a "normally unengaged, fail engaged" position. That is, under normal operating conditions in which there is tension in the climbing rope 18, the roller 104 does not engage with the guide rail 92. Only in a fail condition, that is, where there is a loss of tension in the climbing rope 18, does the roller 104 engage the guide rail 92.

Figure 5:
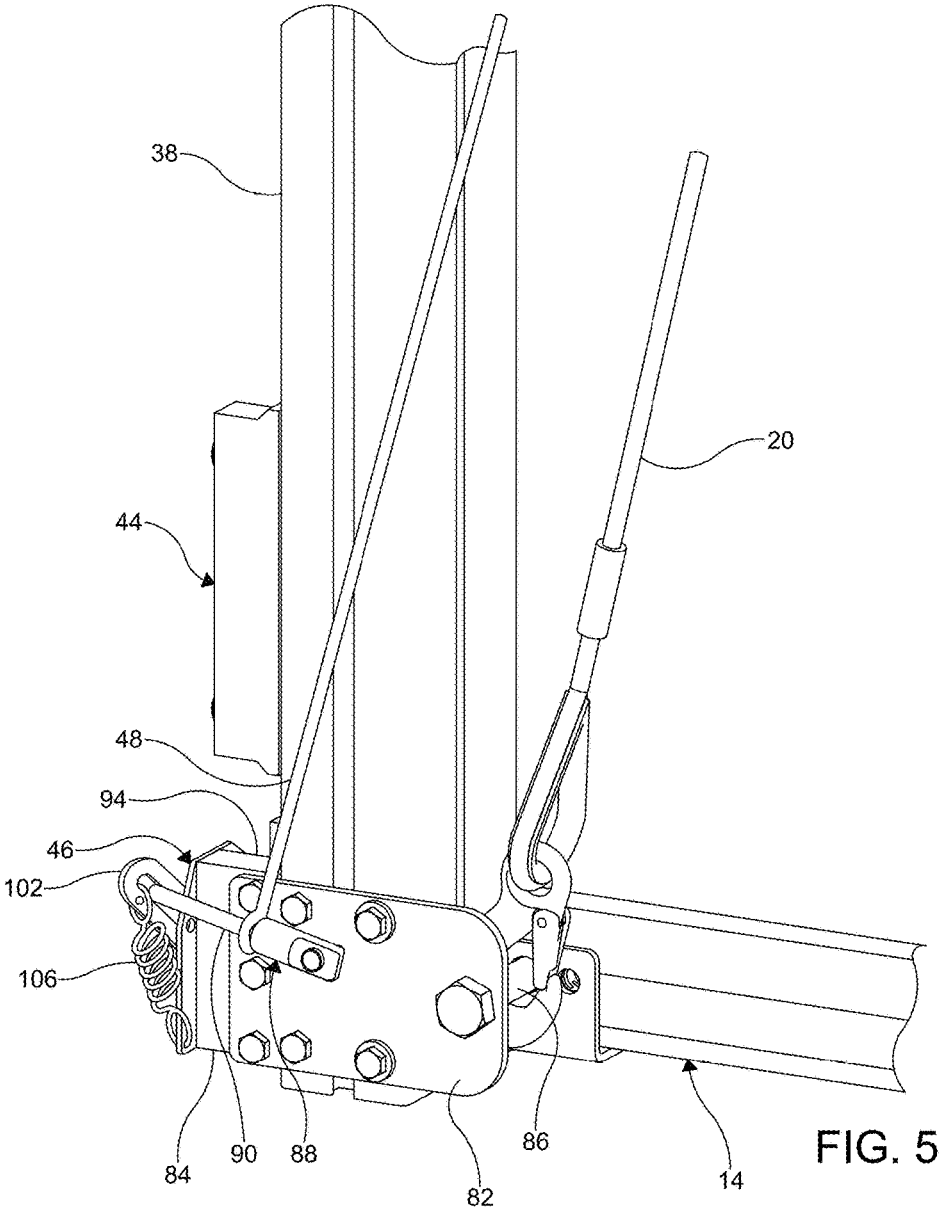
FIG. 5 is a schematic perspective view of a safety assembly of the false car device of FIG. 1.

Referring now to FIG. 3, operation of the safety assembly 46 will now be described. Under normal operating conditions, tension in the climbing rope 18 is transferred to the hoist bracket assembly 58, thereby causing an upward movement of the actuator plate 76 and subsequent compression of the spring device 74. In turn, the upward positioning of the actuator plate 76 urges the safety rope 48 to an upward position. Referring now to FIGS. 5 and 6, the upward position of the safety rope 48 causes the necked portion 90 of the safety lever 88 to rotate in a clockwise direction. In turn, the link arm 102 is urged by the safety lever 88 to rotate in a counterclockwise direction, thereby overcoming the tension force of the lever spring 106 and positioning the roller 104 in an unengaged position relative to the guide rail 92. The roller 104 remains in the unengaged position provided tension is maintained in the climbing rope 18 and the safety rope 48.

Referring now to FIGS. 1 and 4, in the event tension is lost in the climbing rope 18, the lack of tension on the hoist bracket assembly 58 causes the spring device 74 to expand, and in turn causes a downward movement of the actuator plate 76. Next, the downward positioning of the actuator plate 76 urges the safety rope 48 in a downward direction. Referring now to FIG. 7, the downward direction of the safety rope 48 allows the tensile force of the lever spring 106 to force the necked portion 90 of the safety lever 88 to rotate in a counterclockwise direction. In turn, the link arm 102 is urged by the safety lever 88 to rotate in a clockwise direction, thereby forcing the roller 104 to ascend in an upward direction along the inclined member 98. As the roller 104 ascends along the included member 98, an outer surface of the roller 104 edges closer to the face of a guide rail 92 as shown in FIG. 8. The roller 104 continues to travel upwardly along the inclined member 98 until the roller is in an engaged position with the guide rail 92. The roller 104 remains in the engaged position until tension is returned to the climbing rope 18 and the safety rope 48.

Referring again to FIGS. 6-8, as the roller 104 ascends along the inclined member 98, the roller 104 engages the guide rail 92 and is compressed between the guide rail 92 and the inclined member 98, effectively binding the false car device 10 to the guide rail 92. Accordingly, the false car device 10 is prevented from moving within the elevator hoistway.

Returning again to FIGS. 6 and 8, in normal operation with the roller 104 in an unengaged position relative to the guide rail 92, the faces 110 of the guide shoes 108 are centered about and in contact with the guide rail 92. The faces 110 of the guide shoes remain in contact with the guide rail 92 as the false car device 10 moves within the hoistway. Since the faces of the guide shoes are centered about the guide rails 92, a centerline of the guide rails can be determined. Accordingly, the centered contact of the guide shoes 108 about the guide rails 92 allows the false car device 10 to be used as a gauge. That is, with the false car device 10 positioned firmly about the centerline of the guide rails 92, other hoistway equipment (i.e. door fronts) requiring positioning relative to the centerline of the guide rails 92, can be set using the false car device 10 as a positioning device. Using the door front example, since the relative location of the false car device 10 to the guide rails 92 is known, and since the door fronts are set off of the centerline of the guide rails 92, the false car device 10 can be used as a positioning device to accomplish a specific positioning. Advantageously, the components forming the deck 22 and the rail structure 32 are formed from materials, such as for example unistrut, that facilitate use of the false car 10 as a gauge. The materials easily facilitate the attachment of fixtures that are used in locating other hoistway equipment (i.e. door fronts) requiring positioning relative to the centerline of the guide rails 92.

In another non-limiting example, the false car device 10 can be used as a gauge to set the elevator guide rails 92. Since the guide rails 92 can be drawn into the guide assemblies 44 of the false car device 10, and since the guide rails 92 are located on centerline of the elevator hoistway, the false car 10 can be used to set construction parameters, such as the distance between the guide rails 92 (commonly referred to as "DBG"). Additionally, with other equipment such as for example lasers or drop lines, the false car device 10 can also be used to set the location of the guide rails 92 in the hoistway.

While the safety assembly 46 has been described above and illustrated in the Figures as configured in a "normally unengaged, fail engaged" position, it is within the contemplation of the false car invention that the safety assembly 46 can be configured in other arrangements. One example of another arrangement is configuring the safety assembly in a normally engaged, or always on arrangement. In this arrangement, the roller 104 of the safety assembly 46 is normally engaged with the guide rail 92, thereby preventing movement of the false car. Only in the event it is desired to move the false car within the hoistway is the safety assembly disengaged from contact with the guide rail. The safety assembly can be disengaged by any desired structure, mechanism or device.

In accordance with the provisions of the patent statutes, the principle and mode of operation of the false car device 10 have been explained and illustrated in its preferred embodiment. However, it must be understood that the false car device 10 may be practiced otherwise than as specifically explained and illustrated without departing from its spirit or scope.

What is claimed is:

1. A false car device configured for use in an elevator hoistway, the false car device comprising:

a platform assembly;

a frame assembly configured to support the platform assembly, the frame assembly including one or more safety assemblies; and a lift assembly configured to facilitate hoisting of the platform assembly and the frame assembly within the elevator hoistway, the lift assembly having a hoist, a hoist clevis dependent from the hoist, a plurality of side plates and a hoist bracket assembly, the hoist bracket assembly configured in a contracted and an expanded arrangement;

a plurality of safety ropes; and a climbing rope attached to the lift assembly;

wherein the hoist is configured to receive the climbing rope, the plurality of safety ropes each have a first end attached to the lift assembly and a second end connected to the safety assemblies and wherein in the event tension is lost in the climbing rope, the plurality of side plates are configured for slidable movement relative to the hoist clevis and the plurality of safety ropes are configured to actuate the safety assemblies to engage an elevator guide rail.

2. The false car device of claim 1, wherein the safety assembly is configured in an unengaged arrangement when the hoist bracket assembly is in the contracted arrangement and the safety assembly is configured in an engaged arrangement when the hoist bracket assembly is in the expanded arrangement.

3. The false car device of claim 1, further comprising one or more guide assemblies, the guide assemblies including a pair of guide shoes configured to contact opposing faces of the elevator guide rail as the false car device moves within the hoistway.

4. The false car device of claim 1, wherein the frame assembly is suspended from the lift assembly by one or more suspension ropes.

5. The false car of claim 1, wherein at least one of the frame assembly and the platform assembly have an adjustable width and length.

6. The false car device of claim 1, wherein the slidable movement of the plurality of side plates relative to the hoist clevis is defined by a pin extending from the hoist clevis and into a slot within each of the side plates.

7. The false car device of claim 1, wherein the plurality of side plates have a contracted arrangement with tension in the climbing rope and are further configured for an expanded arrangement when tension in the climbing rope is lost.

8. The false car device of claim 1, wherein a plurality of guide rods extend from the hoist clevis and attach to a safety actuator, the safety actuator configured to actuate engagement of the safety assembly when tension in the climbing rope is lost.

9. The false car device of claim 8, wherein the safety actuator includes a spring device configured for a contracted arrangement with tension in the climbing rope and further configured for an expended arrangement when tension in the climbing rope is lost.

10. The false car device of claim 8, wherein the plurality of guide rods extend from the hoist clevis and attach to an actuator plate, the actuator plate configured to receive one end of the spring device.

11. The false car device of claim 1, wherein each of the plurality of safety ropes is connected to a link arm of the safety assembly and configured to actuate a pivoting motion of the link arm.

12. The false car device of claim 11, wherein the link arm is configured to actuate upward motion of a roller against an inclined member.

13. The false car device of claim 12, wherein upward motion of the roller against the inclined member is configured to bring the roller into contact with a guide rail.

14. The false car device of claim 13, wherein a channel is formed between the roller and a plurality of spacers attached to the safety assembly, the plurality of spacers configured to adjust a width of the channel.

15. The false car device of claim 1, wherein an overspeed device is coupled to the lift assembly and is configured to prevent overspeeding of the false car device.

16. The false car device of claim 15, wherein a secondary rope is received by the overspeed device and engaged by the overspeed device in the event the false car device exceeds a maximum desired speed.

* * * * *